US008170180B2

(12) United States Patent
Parker

(10) Patent No.: US 8,170,180 B2
(45) Date of Patent: May 1, 2012

(54) ROTATING ANODE WITH HUB CONNECTED VIA SPOKES

(75) Inventor: Todd S. Parker, Kaysville, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 58 days.

(21) Appl. No.: 12/488,429

(22) Filed: Jun. 19, 2009

(65) Prior Publication Data

US 2010/0322384 A1 Dec. 23, 2010

(51) Int. Cl.
*H01J 35/10* (2006.01)

(52) U.S. Cl. ..... 378/143; 378/141

(58) Field of Classification Search ..... 378/143, 378/127, 141, 125, 119
See application file for complete search history.

(56) References Cited

U.S. PATENT DOCUMENTS

| | | | | |
|---|---|---|---|---|
| 5,020,087 | A * | 5/1991 | Rix et al. | 378/134 |
| 6,603,834 | B1 * | 8/2003 | Lu et al. | 378/141 |
| 2011/0129068 | A1 * | 6/2011 | Lewalter et al. | 378/127 |

* cited by examiner

*Primary Examiner* — Hoon Song
(74) *Attorney, Agent, or Firm* — Maschoff Gilmore & Israelsen

(57) ABSTRACT

One example embodiment includes an anode. The anode comprises an anode hub, an annular target and a plurality of spokes. The spokes connect the anode hub to the annular target. The spokes are configured to substantially mechanically and/or thermally isolate the anode hub from the annular target.

21 Claims, 12 Drawing Sheets

ROTATING ANODE WITH HUB CONNECTED VIA SPOKES

BACKGROUND

1. The Field of the Invention

Embodiments of the present invention relate generally to x-ray devices. More particularly, embodiments of the present invention relate to anodes.

2. The Related Technology

The x-ray tube has become essential in medical diagnostic and inspection imaging, medical therapy, and various medical testing and material analysis industries. Such equipment is commonly employed in areas such as medical and industrial diagnostic examination, therapeutic radiology, semiconductor fabrication, and materials analysis.

An x-ray tube typically includes a vacuum enclosure that contains a cathode assembly and an anode assembly. The vacuum enclosure may be composed of metals, glass, ceramic, or a combination thereof, and is typically disposed within an outer housing. At least a portion of the outer housing may be covered with a shielding layer (composed of, for example, lead or a similar x-ray attenuating material) for preventing the escape of x-rays produced within the vacuum enclosure. In addition, a cooling medium such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating the coolant to an external heat exchanger via a pump and fluid conduits. The cathode assembly generally consists of a metallic cathode head assembly and a source of electrons highly energized for generating x-rays. The anode assembly, which is generally manufactured from a refractory metal such as tungsten, includes a focal track that is oriented to receive electrons emitted by the cathode assembly.

The anode assembly in some x-ray tubes includes a rotating anode comprising a solid disk target, an annular focal track located near the outer perimeter of the target, and an anode hub formed at the center of the anode for mounting the anode to an anode support assembly inside the vacuum enclosure. The anode support assembly includes, among other things, a support shaft and a rotating bearing assembly supporting the anode.

During operation of the x-ray tube, the anode is rotated and the cathode is charged with a heating current that causes electrons to escape the electron source or emitter. An electric potential is applied between the cathode and the anode in order to accelerate the emitted electrons toward the annular focal track of the anode. X-rays are generated by a portion of the highly accelerated electrons striking the annular focal track.

In order to produce high-quality x-ray images it is generally desirable to maximize x-ray flux, i.e., the number of x-ray photons emitted per unit time. An intense x-ray beam is useful for collecting high-contrast images in as short a period of time as possible. X-ray flux can be increased by increasing the number of electrons emitted by the emitter that impinge on the annular focal track. The flow of electrons from the cathode to the anode transports large amounts of energy to the anode. Target power is a measure of the energy transmitted to the anode per unit time and depends on the electron flux, i.e., the number of electrons emitted per unit time.

The majority of the energy transported to the anode takes the form of thermal energy, or heat. The thermal energy raises the temperature of the annular focal track and the outer perimeter of the target. The anode is rotated to spread the thermal energy around the outer perimeter of the target, allowing for greater target power loads than in x-ray tubes with non-rotating anodes. However, the maximum amount of heat per unit time that the anode can safely handle without being damaged, also referred to as the anode heat input rate capability or anode ratability, limits the maximum target power, and consequently the maximum electron flux and maximum x-ray flux of the x-ray tube.

The anode ratability can be increased by increasing the rotational speed of the anode. However, the rotation of the anode creates stress in the anode. More particularly, the rotation of the anode and the high temperatures at the annular focal track and outer perimeter of the target cause the annular focal track and outer perimeter of the target to radially expand. The radial expansion of the annular focal track and outer perimeter of the target create stresses in the anode that can damage the anode. Higher rotational speeds and higher temperatures result in greater radial expansion and larger stresses. Larger stresses reduce the lifetime of the anode.

Further, where the target comprises a solid disk, thermal energy at the outer perimeter of the target has a 360° thermal conductive path to the anode hub. As a result, a large portion of the thermal energy at the outer perimeter of the target is conductively transferred to the hub and raises the temperature of the hub. In high-power x-ray tubes with solid-disk-type anodes, the temperature of the focal track and outer perimeter of the target can reach 1200° C. or higher, while the temperature of the anode hub may be only a few degrees cooler at around 1100° C. Some approaches that have been taken to prevent overheating and damaging the bearing assembly or otherwise reducing the lifetime of the bearing assembly may result in magnification of load imbalances of the anode on the bearing assembly and thus decrease the useful life of the bearing assembly.

The subject matter claimed herein is not limited to embodiments that solve any disadvantages or that operate only in environments such as those described above. Rather, this background is only provided to illustrate one technology area where some embodiments described herein may be practiced

BRIEF SUMMARY OF SOME EXAMPLE EMBODIMENTS

In general, example embodiments of the invention relate to anodes.

One example embodiment includes an anode. The anode comprises an anode hub, an annular target and a plurality of spokes. The spokes connect the anode hub to the annular target. The spokes are configured to substantially mechanically isolate the anode hub from the annular target.

Another example embodiment includes an x-ray tube. The x-ray tube comprises an evacuated enclosure, a cathode disposed within the evacuated enclosure, and an anode disposed within the evacuated enclosure opposite the cathode so as to receive electrons emitted by the cathode. The anode comprises an anode hub, an annular target and a plurality of spokes. The spokes connect the anode hub to the annular target. Each of the spokes is substantially tangentially connected to the anode hub.

Yet another example embodiment includes a method of making an anode. The method comprises forming an anode hub in an anode blank, forming an annular target in the anode blank, and forming a plurality of spokes in the anode blank. The annular target comprises a focal track and a substrate at an outer perimeter of the anode blank. The annular target is substantially concentric with the anode hub. The spokes each have a hub end substantially tangentially connected to the anode hub and a target end connected to the annular target. The anode hub, substrate, and spokes are integral with each other.

These and other aspects of example embodiments of the invention will become more fully apparent from the following description and appended claims.

BRIEF DESCRIPTION OF THE DRAWINGS

To further clarify various aspects of some embodiments of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Embodiments of the present invention are generally directed to an anode used to produce x-rays in response to the impingement of electrons on the anode. Some example embodiments include an anode comprising a hub and a target, the anode being designed to substantially thermally and/or mechanically isolate the hub from the target. Thermally and mechanically isolating the hub from the target allows the anode to be operated at relatively higher rotational speeds to tolerate increased instantaneous target power loads without significantly reducing the life of the anode. Alternately or additionally, thermally and mechanically isolating the hub from the target increases the life of a corresponding ball bearing assembly through reduced hub temperatures and closer placement of the ball bearing assembly to the center of mass of the anode and other rotating elements.

Reference will now be made to the figures wherein like structures will be provided with like reference designations. It is understood that the figures are diagrammatic and schematic representations of some embodiments of the invention, and are not limiting of the present invention, nor are they necessarily drawn to scale.

I. Example Operating Environment

Figure 1:
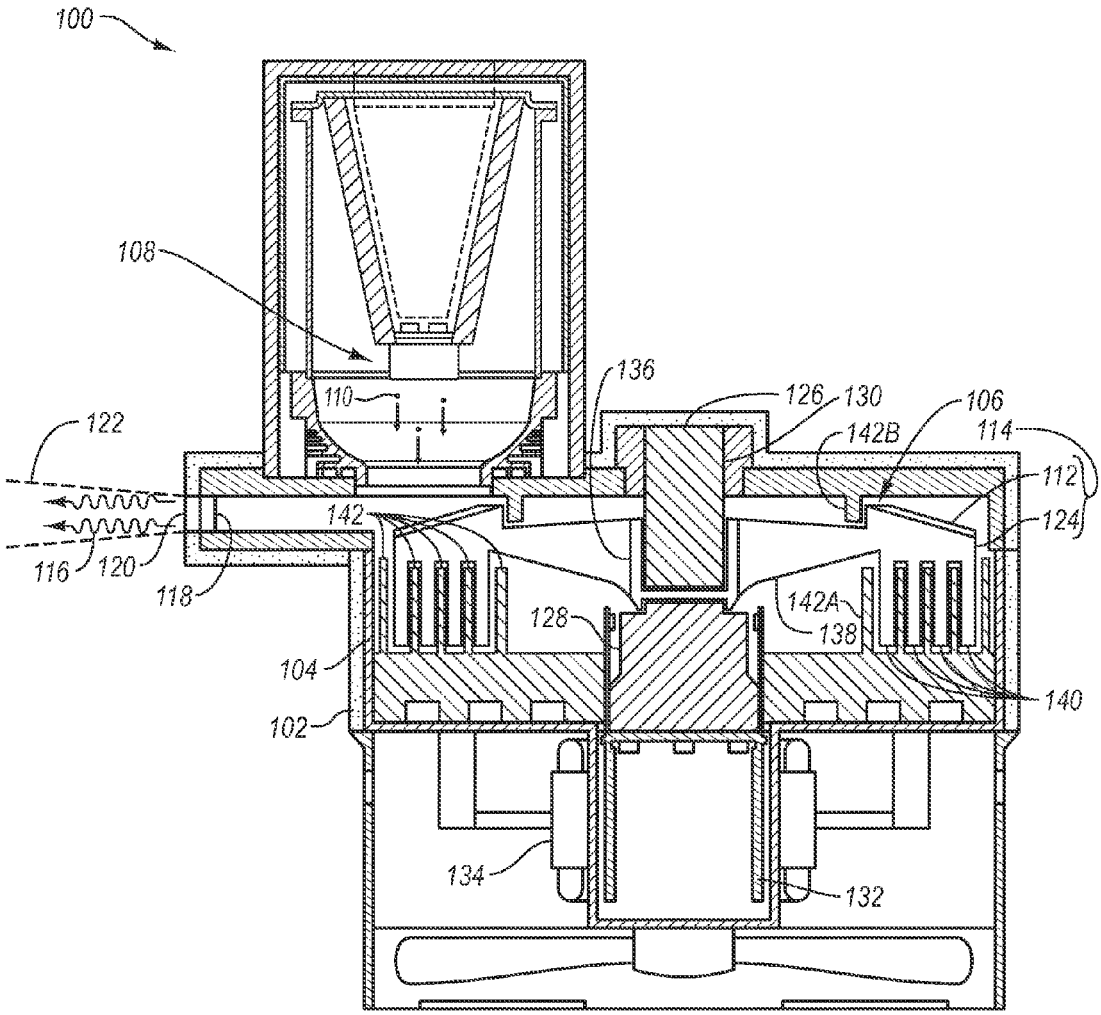
FIG. 1 is a simplified cross-sectional depiction of an x-ray tube incorporating an anode according to an embodiment of the invention.

Reference is first made to FIG. 1, which illustrates a simplified structure of a rotating anode-type x-ray tube, designated generally at 100. X-ray tube 100 includes an outer housing 102, within which is disposed an evacuated enclosure 104. A cooling fluid (not shown) is also disposed within the outer housing 102 and circulates around the evacuated enclosure 104 to assist in x-ray tube cooling and to provide electrical isolation between the evacuated enclosure 104 and the outer housing 102. In some embodiments, the cooling fluid may comprise dielectric oil, which exhibits desirable thermal and electrical insulating properties for some applications, although cooling fluids other than dielectric oil can alternately or additionally be implemented in the x-ray tube 100.

Disposed within the evacuated enclosure 104 are an anode 106 and a cathode 108. The anode 106 is spaced apart from and oppositely disposed to the cathode 108, and may be at least partially composed of a thermally conductive material such as copper or a molybdenum alloy. The anode 106 and cathode 108 are connected in an electrical circuit that allows for the application of a high voltage potential between the anode 106 and the cathode 108. The cathode 108 includes a filament (not shown) that is connected to an appropriate power source and, during operation, an electrical current is passed through the filament to cause electrons, designated at 110, to be emitted from the cathode 108 by thermionic emission. The application of a high voltage differential between the anode 106 and the cathode 108 then causes the electrons 110 to accelerate from the cathode filament toward a focal track 112 that is positioned on a target 114 of the anode 106. The focal track 112 is typically composed of tungsten or other material(s) having a high atomic ("high Z") number. As the electrons 110 accelerate, they gain a substantial amount of kinetic energy, and upon striking the target material on the focal track 112, some of this kinetic energy is converted into electromagnetic waves of very high frequency, i.e., x-rays 116, shown in FIG. 1.

The focal track 112 is oriented so that emitted x-rays are directed toward an evacuated enclosure window 118. The evacuated enclosure window 118 is comprised of an x-ray transmissive material that is positioned within a port defined in a wall of the evacuated enclosure 104 at a point aligned with the focal track 112. An outer housing window 120 is disposed so as to be at least partially aligned with the evacuated enclosure window 118. The outer housing window 120 is similarly comprised of an x-ray transmissive material and is disposed in a port defined in a wall of the outer housing 102. The x-rays 116 that emanate from the evacuated enclosure 104 and pass through the outer housing window 120 may do so substantially as a conically diverging beam, the path of which is generally indicated at 122 in FIG. 1.

Additionally, the anode 106 target 114 includes a substrate 124, comprising graphite in some embodiments. The anode 106 is rotatably supported by an anode support assembly 126. The anode support assembly 126 generally comprises a bearing assembly 128, a support shaft 130, and a rotor sleeve 132. The support shaft 130 is fixedly attached to a portion of the evacuated enclosure 104 such that the anode 106 is rotatably supported by the support shaft 130 via the bearing assembly 128, thereby enabling the anode 106 to rotate with respect to the support shaft 130. A stator 134 is disposed about the rotor sleeve 132 and utilizes rotational electromagnetic fields to cause the rotor sleeve 132 to rotate. The rotor sleeve 132 is attached to the anode 106, thereby enabling the rotation of the anode 106 during x-ray tube 100 operation.

FIG. 1 discloses one example environment in which an anode 106 according to embodiments of the invention might be utilized. However, it will be appreciated that there are many other x-ray tube configurations and environments for which embodiments of the anode 106 would find use and application.

II. Anode

According to some embodiments of the invention, the anode 106 is configured to substantially thermally and/or mechanically isolate a hub 136 of the anode 106 from the target 114 via a plurality of spokes 138. Such thermal and/or mechanical isolation of the hub 136 from the target 114 can allow the anode 106 to tolerate higher instantaneous target power loads and can increase the life of the bearing assembly 128 compared to a conventional solid disk-type anode.

The anode 106 optionally includes a plurality of fins 140 or other heat radiating structures integrally formed in the substrate 124. The substrate 124 fins 140 are configured to radiate thermal energy away from the target 114. A complementary set of fins 142 can be formed in the evacuated enclosure 104 and interleaved with the substrate 124 fins 140. In some embodiments, the fins 142 are in thermal communication with the outer housing 102 via the evacuated enclosure 104. Consequently, thermal energy radiated by the fins 140 can be absorbed by the evacuated enclosure 104 fins 142 and then transferred by thermal conduction to the outer housing 102 and/or a cooling system away from the anode 106. Alternately or additionally, other heat management structures and/or techniques may be employed to manage heat generated at the anode 106.

Reference will next be made to FIGS. 2A-9 to describe aspects of some example anodes according to some embodiments of the invention. The examples disclosed in FIGS. 2A-9 and discussed herein are only some of countless anode configurations according to some embodiments of the invention and should not be construed to limit the invention.

A. Integral Anode

Aspects of one example anode 200 configured to thermally and/or mechanically isolate a hub from a target of the anode 200 via a plurality of spokes will first be described with respect to FIGS. 2A-2D. FIGS. 2A-2D illustrate, respectively, a top perspective view, a bottom perspective view, a top view, and a cross-sectional side view of the anode 200. As shown in FIGS. 2A-2D, the anode 200 comprises a hub 202, a target 204 and a plurality of spokes 206.

The hub 202 defines a first axis of rotation Al and can define a substantially cylindrical inner cavity 202A configured to receive one or more other components to which the anode 200 can be attached. For instance, in some embodiments, the inner cavity 202A is configured to receive a support shaft and/or a bearing assembly of an anode support assembly, such as the support shaft 130 and bearing assembly 128 of the anode support assembly 126 of FIG. 1.

As will be explained in greater detail below, the anode 200 is configured to thermally isolate the hub 202 from the target 204 such that, in one example embodiment, the hub 202 may operate at temperatures that are approximately 500-1000° C. or more cooler than operating temperatures at the target 204. For instance, the thermal isolation of the hub 202 may allow the hub 202 to operate at approximately 200° C., whereas the target 204 may operate at approximately 1200° C. In this and other embodiments, the relatively low operating temperatures of the hub 202 permit the hub 202 to be made from materials not previously feasible in high-power x-ray tubes. For instance, the hub 202 can comprise stainless steel, including 304L stainless steel, or a high-performance alloy, such as Hastelloy B or Hastelloy C, or other suitable material(s). Alternately or additionally, the hub 202 can comprise one or more materials having relatively low thermal conductivity and/or low emissivity so as to limit thermal conduction and/or radiation from the hub 202 to a corresponding bearing assembly coupled to the hub 202. Alternately or additionally, the hub 202 can be made from the same material(s) as the target 204 and/or spokes 206 and can comprise refractory material(s) such as tungsten, rhenium, or the like.

The target 204 is substantially annular in shape and is substantially concentric and/or coaxial with the hub 202, the target 204 defining an inner surface 204A. The target 204 comprises a focal track 208 and a substrate 210. The focal track 208 and substrate 210 may correspond to, respectively, focal track 112 and substrate 124 of the anode 106 of FIG. 1.

The target 204 in some embodiments comprises refractory material(s) capable of tolerating high temperatures, e.g. approximately 1200° C. and higher, and high temperature stresses. Accordingly, the target 204 can comprise one or more of: tungsten, rhenium, titanium-zirconium-molybdenum ("TZM") alloy, magnesium-hafnium carbide ("MHC") alloy, molybdenum, graphite, tantalum carbide, tantalum-hafnium carbide, or other suitable material(s).

Each of the spokes 206 includes a hub end 212 and a target end 214. The target end 214 of each spoke 206 is connected to the inner surface 204A of target 204. The hub ends 212 can be radially connected to the hub 202, tangentially connected to the hub 202, or any combination thereof In the example of FIGS. 2A-2D each hub end 212 is connected to the hub 202 in a substantially tangential manner. Generally, a linear or substantially linear spoke is connected to a circular or substantially circular hub in a substantially tangential manner if the spoke touches the hub at a single point without intersecting the hub. In the context of non-linear spokes and/or non-circular hubs, a spoke is connected to the hub in a substantially tangential manner if a hub end of the spoke (approximated by a straight line) touches the hub (approximated by a circle) at a single point without intersecting the hub. Accordingly, in the example of FIG. 2C, the spokes 206 are substantially tangentially connected to the hub 202 because the hub ends 212 (approximated as straight lines) touch the hub 202 (approximated by a circle) at a single point without intersecting the hub 202. As will be explained below with respect to FIG. 10, however, embodiments of the invention are not limited to anodes having substantially linear spokes or to anodes having spokes that are substantially tangentially connected to the hub.

The spokes 206 and the tangential attachment of the spokes 206 to the hub 202 substantially mechanically isolate the hub 202 from the target 204. More particularly, as will be explained in greater detail below with respect to FIG. 5A, the tangential attachment of the spokes 206 to the hub 202 allows the target 204 to radially expand and contract during operation without substantially exposing the spokes 206 to tensile forces (e.g., forces tending to elongate the spokes 206) and/or communicating radial stresses caused by the radial expansion/contraction of the target 204 to the hub 202. To this end, the spokes 206 can be configured to deform or be displaced in the x- and/or y-directions as the target 204 expands and/or contracts. For instance, the spokes 206 can be hinged at one or both of the hub ends 212 or target ends 214. Alternately or additionally, the spokes 206 can be resiliently deformable.

Further, the spokes 206 substantially thermally isolate the hub 202 from the target 204 by restricting the thermal conductive paths from the target 204 to the hub 202. For instance, a solid disk-type anode would include a 360° thermal conductive path from the outer perimeter of the anode to the center of the solid disk-type anode. As a result, a temperature difference from the outer perimeter to the center of a solid disk-type anode may be only 100° C. or less. In contrast, the anode 200 includes spokes 206 that limit thermal conduction between the target 204 and hub 202 to the spokes 206, since spokes 206 have a much smaller thermal cross-section than a solid-disk-type anode. Consequently, the amount of heat transferred from the target 204 to the hub 202 via thermal conduction is significantly smaller than the heat transferred from the outer perimeter to the center of a solid disk-type anode via thermal conduction under similar target power loads.

The anode 200 is configured to substantially thermally isolate the hub 202 from the target 204 by both conductive and radiative isolation of the hub 202. For instance, the relatively small thermal cross-section of the spokes 206 compared to the thermal cross-section of a 360° conductive path in a solid disk-type anode substantially conductively isolates the hub 202 from the target 204 by limiting the thermal conduction between the target 204 and the hub 202 to the spokes 206.

Further, the distance between the target 204 and hub 202 substantially radiatively isolates the hub 202 from the target 204. The substantial radiative isolation of the hub 202 from the target 204 can optionally be enhanced by providing one or more obscuring structures between the hub 202 and the target 204. For instance, with combined reference to FIGS. 1-2D, the evacuated enclosure 104 fins 142 can include a lower fin 142A and/or an upper fin 142B at least partially interposed between the target 204 and the hub 202. The lower and upper fins 142A, 142B at least partially shield the hub 202 from thermal energy radiated by the target 204 by absorbing some of the radiated thermal energy and conducting the absorbed thermal energy away from the anode 200 via the evacuated enclosure 104 and/or the outer housing 102.

Returning to FIGS. 2A-2D, the spokes 206 can be configured in a variety of ways to reduce the amount of thermal energy conductively transferred from the target 204 to the hub 202. Generally, the thermal energy conductively transferred from the target 204 to the hub 202 depends on the cross-section along the length of the spokes 206. Reducing the cross-section of the spokes 206 reduces the amount of thermal energy conductively transferred from the target 204 to the hub 202. Accordingly, in the example of FIGS. 2A-2D, each of spokes 206 has a sufficiently small cross-section along its length to substantially choke thermal energy from being conductively transferred from the target 204 to the hub 202. Alternately or additionally, the spokes 206 can include one or more cutouts (see, e.g., FIG. 3) that reduce the cross-section of the spokes 206.

Alternately or additionally, the cross-section along the length of the spokes 206 can be reduced by forming the spokes 206 with cross-sectional shapes that enhance section moment of inertia of the spokes 206 while simultaneously reducing cross-sectional area of the spokes 206. Section moment of inertia of the spokes 206 refers to the resistance of the spokes 206 to buckling (e.g., Euler buckling) along their length. One spoke configuration having a reduced cross-section that enhances section moment of inertia is disclosed in FIG. 3. In particular, the spokes of FIG. 3 essentially have a C-shaped cross-section that reduces the cross-section of the spokes and associated conductive transfer of thermal energy while enhancing the section moment of inertia of the spokes.

Figure 2A:
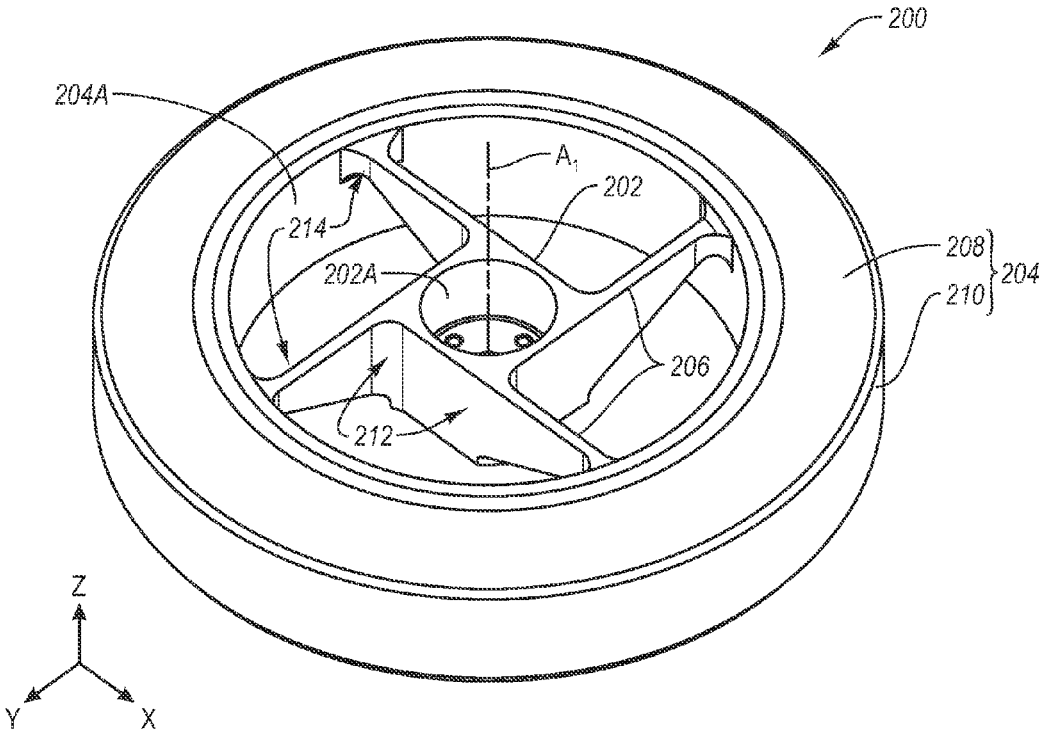
FIGS. 2A-2D illustrate various views of one example anode such as may be employed in the x-ray tube of FIG. 1.
Figure 2B:
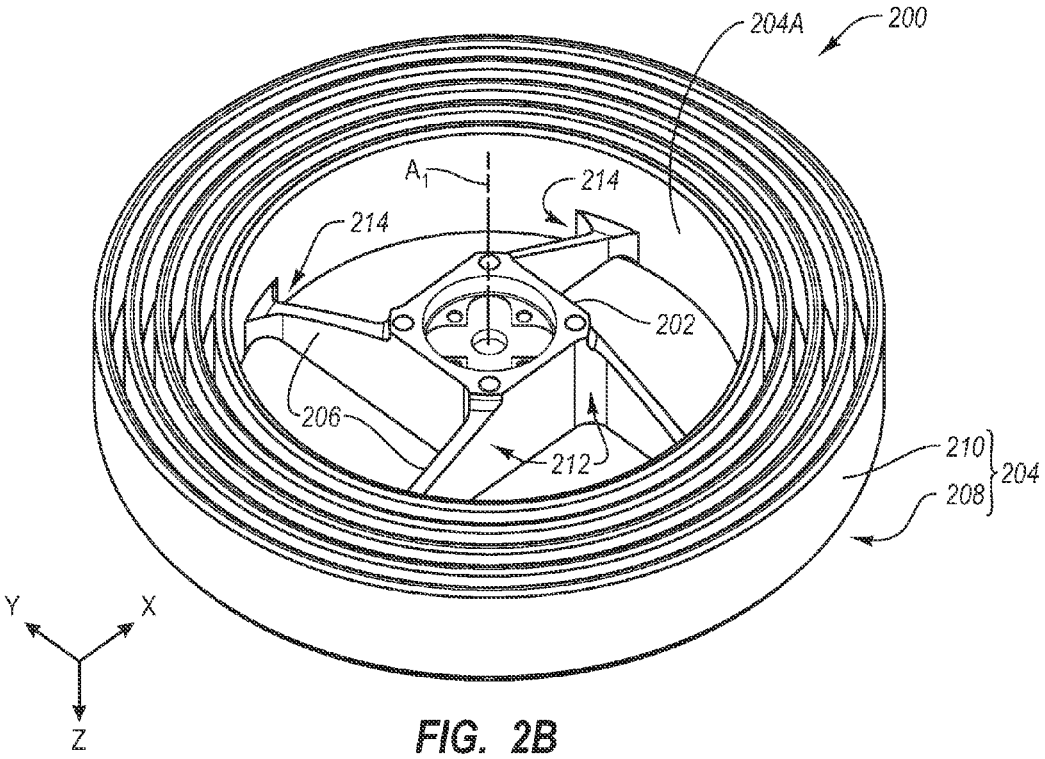

Returning to FIGS. 2A-2D, the spokes 206 can alternately or additionally be configured to stabilize the target 204 in the z-direction during operation. For example, as best seen in FIG. 2D, each of spokes 206 can comprise a substantially wedge-shaped body 206A that is thicker at the hub end 212 than at the target end 214. The wedge shape of the spokes 206 is configured to reduce deflection of the target 204 out of its plane of rotation, i.e., along the axis of rotation of the target 204.

The spokes 206 can be made from plate or sheet materials, wire, tubing, or other suitable material(s). In some embodiments, the spokes 206 comprise material(s) characterized by a relatively low thermal conductivity to limit the heat that can reach the hub 202 via thermal conduction. Alternately or additionally, the material(s) of the spokes 206 can be characterized by a relatively high emissivity to increase the amount of heat radiated by the spokes 206 and thereby decrease the amount of heat that ultimately reaches the hub 202 via thermal conduction. Alternately or additionally, the spokes 206 can comprise material(s) characterized by low work hardening to facilitate resilient or elastic deformation of the spokes 206 and/or characterized by high re-crystallization temperature to tolerate operating temperatures of the anode 200. Accordingly, in some embodiments, the spokes 206 comprise one or more of tantalum, niobium, hafnium, zirconium, titanium, vanadium, high-content alloys of the aforementioned elements, or other suitable material(s). Alternately or additionally, the spokes 206 can be made from the same material(s) as the hub 202 and/or target 204.

Figure 2C:
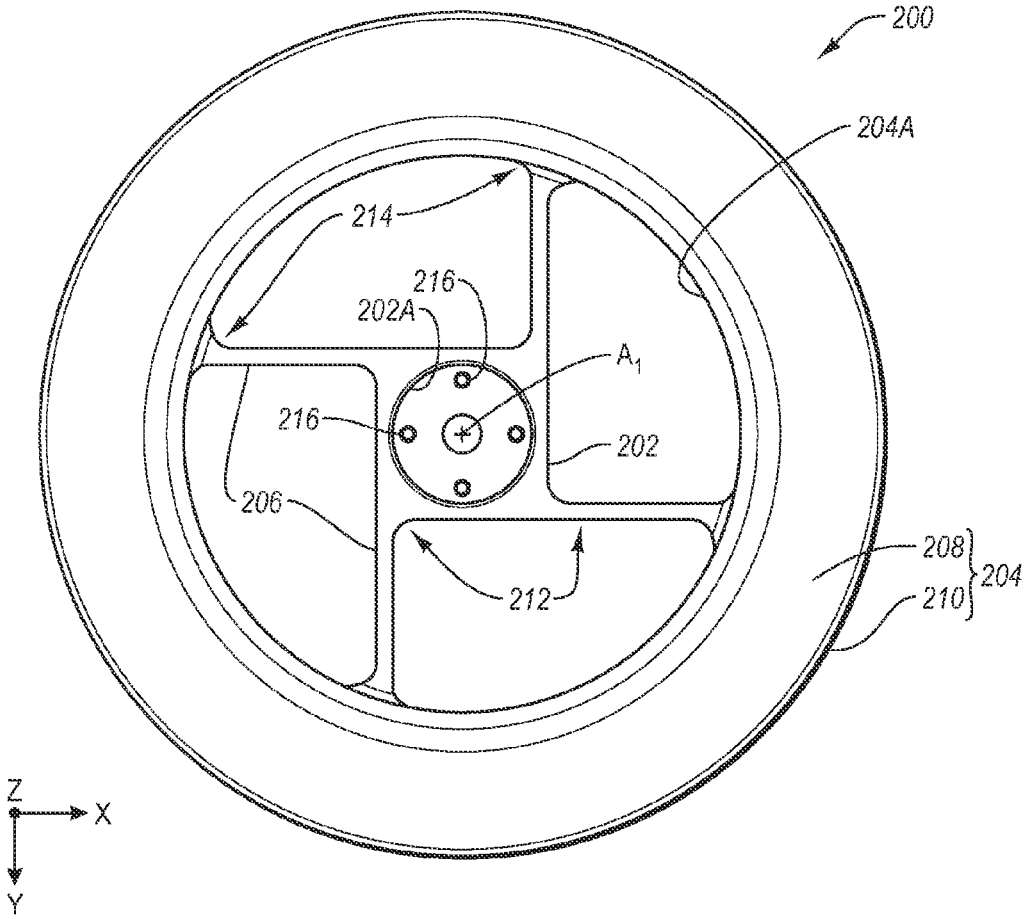
Figure 2D:
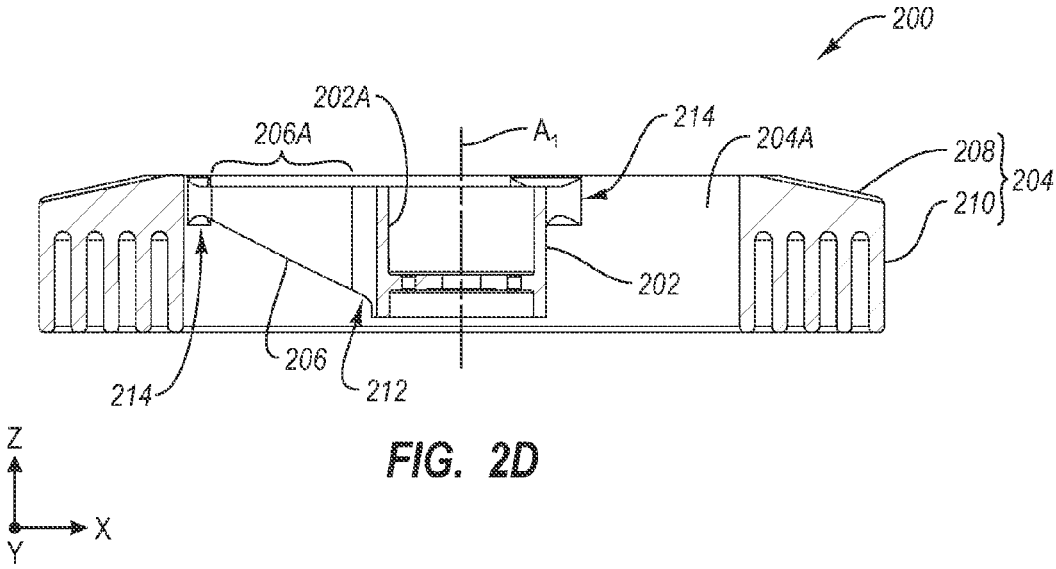

As best seen in FIG. 2C, the hub 202 can include a plurality of through holes 216. The through holes 216 are configured to receive screws, bolts or other fasteners to secure the anode 200 to an anode support assembly. For instance, with combined reference to FIGS. 1 and 2C, each of through holes 216 can receive a screw, bolt or other fastener to secure the anode 200 to the bearing assembly 128 or support shaft 130 of the anode support assembly 126.

In some embodiments, the relatively low operating temperatures at the hub 202 due to the substantial thermal isolation of the hub 202 from the target 204 allows the hub 202 to be secured directly to the bearing assembly 128 and/or can improve the life of the bearing assembly. For instance, such proximal attachment of the bearing assembly 128 to the hub 202 reduces the load imbalances on the bearing assembly 128 compared to a bearing assembly that is spatially separated from the anode. In direct contrast, the centers of solid disk-type anodes and/or other types of anodes operate at temperatures that are only a few degrees lower than the temperatures at the outer perimeter of the solid disk-type anodes. The relatively high temperatures at the centers of solid disk-type anodes require a large spatial separation and/or long thermal path between the centers of the solid-disk-type anodes and the bearing assemblies to allow the thermal energy to dissipate and to prevent overheating of the bearing assemblies.

While the hub 202, target 204 and/or spokes 206 have been disclosed as comprising materials that are not necessarily the same, embodiments of the invention contemplate anodes 200 comprising hubs 202, targets 204 and/or spokes 206 of the same material(s). For instance, in the example of FIGS. 2A-2D, the hub 202, spokes 206 and substrate 210 of target 204 are integral with each other and comprise the same material(s). Alternately or additionally, the hub 202, spokes 206 and substrate 210 can be integrally formed from, e.g. an anode blank. In other embodiments, the hub 202, spokes 206 and all or a portion of the target 204 are not integral with each other and can comprise the same or different materials.

B. Non-Integral Anode

FIGS. 2A-2D disclose one example anode 200 configured to substantially mechanically and/or thermally isolate the anode 200 hub 202 from the anode 200 target 204. The hub 202, target 204 substrate 210 and spokes 206 are integral with each other in the example of FIGS. 2A-2D. However, embodiments of the invention are not limited to anodes comprising hubs, target substrates and/or spokes that are integral with each other.

Figure 3:
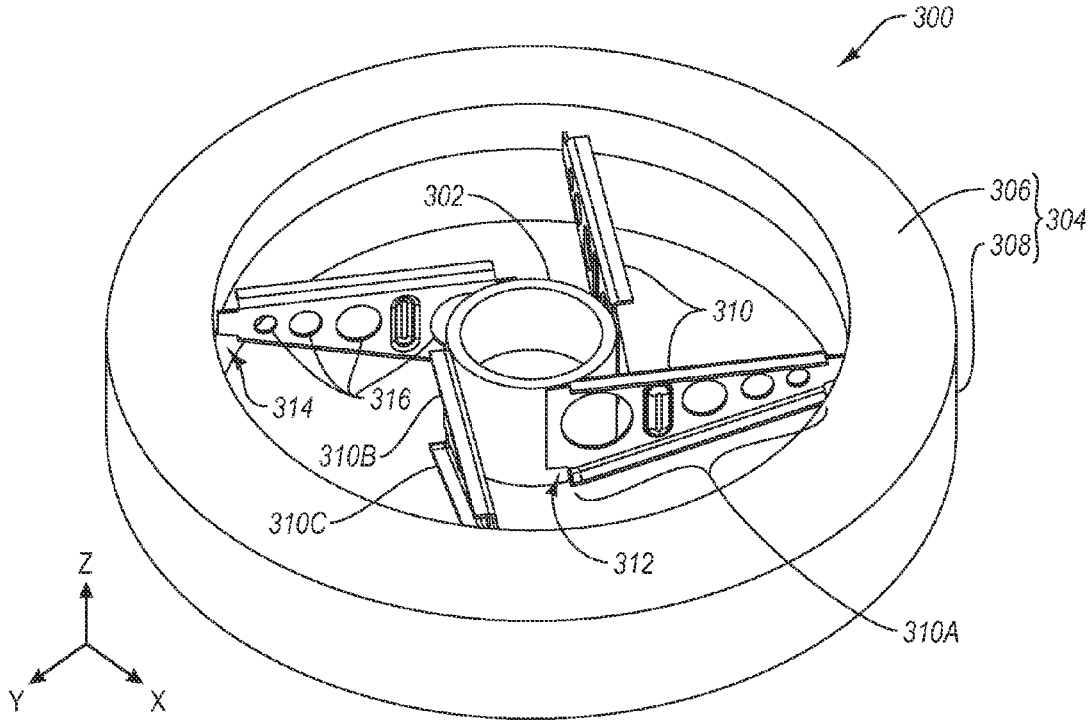
FIG. 3 is a perspective view of another example anode having one or more discrete components.

For instance, FIG. 3 discloses one example of an anode 300 configured to substantially mechanically and/or thermally isolate a hub 302 from a target 304, comprising a focal track 306 and a substrate 308, via a plurality of spokes 310 that are substantially tangentially connected to the hub 302. The hub 302, target 304 and spokes 310 are similar in function to the hub 202, target 204 and spokes 206 of the anode 200 of FIGS. 2A-2D. In contrast to the anode 200 of FIGS. 2A-2D, however, the anode 300 includes a hub 302, target 304 substrate 308, and spokes 310 that are not integral with each other.

In the example of FIG. 3, each of the spokes 310 comprises sheet metal. Further, each of the spokes 310 includes a resilient hub end 312, a resilient target end 314, a substantially wedge-shaped body 310A, and a plurality of flanges 310B, 310C formed lengthwise between the hub end 312 and the target end 314. The resilient hub end 312 and resilient target end 314 of each spoke 310 allow the spokes 310 to resiliently deform in the arbitrarily-defined x-y plane to accommodate radial expansion and contraction of the target 304. Although both of the hub end 312 and target end 314 are resiliently deformable at normal operating temperatures of the anode 300 in the present example, other embodiments of the invention include spokes that are resiliently deformable at normal operating temperatures of the anode 300 at only one of the hub end 312 or the target end 314.

The wedge-shaped body 310A of each spoke 310 is narrower in the z-direction at the target end 314 than the hub end 312 to limit the conduction of thermal energy from the target 304 to the hub 302. To further limit the conduction of thermal energy from the target 304 to the hub 302, a plurality of cutouts 316 are formed in each wedge-shaped body 310A. Accordingly, the cutouts 316 operate to reduce the thermal cross-section of each spoke 310.

The flanges 310B, 310C provide structural support to each spoke 310, substantially preventing the spokes 310 from bending in the positive or negative z-direction. Thus, the flanges 310B, 310C are configured to substantially prevent the target 304 from moving axially with respect to the hub 302, while the resilient hub end 312 and target end 314 allow the spokes 310 to resiliently deform to accommodate the radial expansion and contraction of the target 304 with respect to the hub 302. While the present example illustrates two flanges 310B, 310C formed lengthwise along the edges of each wedge-shaped body 310A, in other embodiments a single flange 310B or 310C can be formed lengthwise along a single edge of each wedge-shaped body 310A. Any other spoke configurations that may control or prevent Euler buckling in the radial direction may be employed.

C. Anode with Integral Heatsinks

In each of the anodes 200 and 300 of FIGS. 2A-3, the anodes 200 and 300 are configured to substantially thermally isolate the hub 202, 302 from the target 204, 304 by substantial conductive and radiative isolation of the hub 202, 302 from the target 204, 304. However, embodiments of the invention are not limited to anodes that substantially thermally isolate hubs from targets by substantial conductive and radiative isolation of the hub from the target. Indeed, embodiments of the invention extend to anodes that substantially thermally isolate hubs from targets by only one of substantial conductive or radiative isolation of the hub from the target.

Figure 4A:
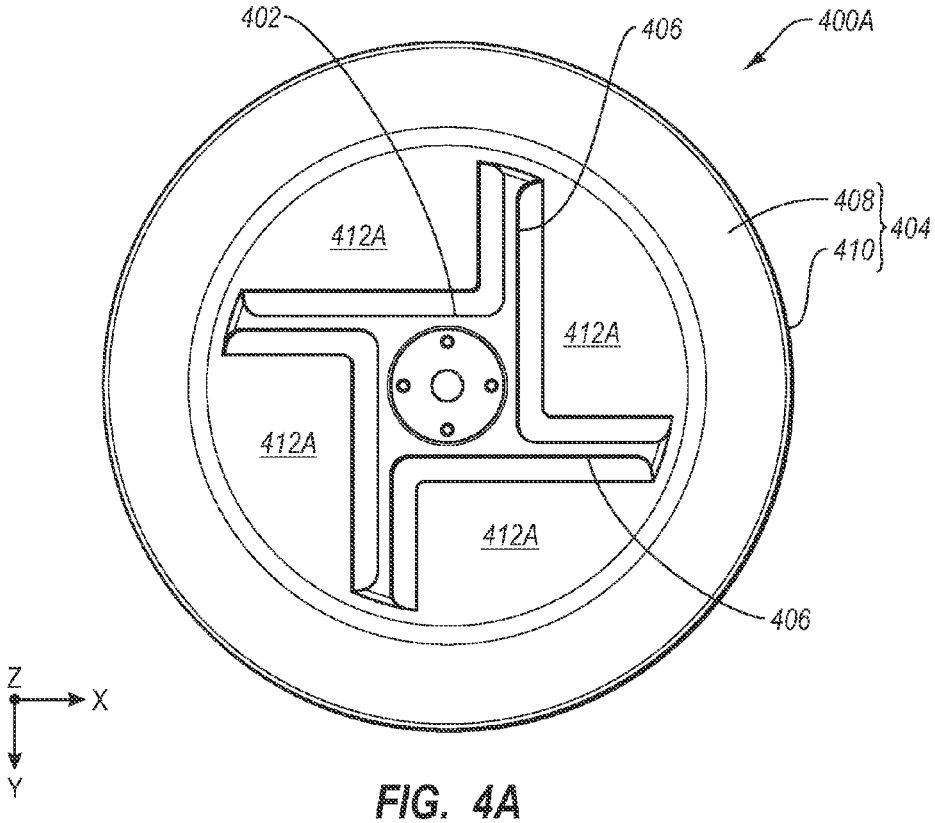
FIGS. 4A and 4B are top views of yet other example anodes having integral heatsinks.
Figure 4B:
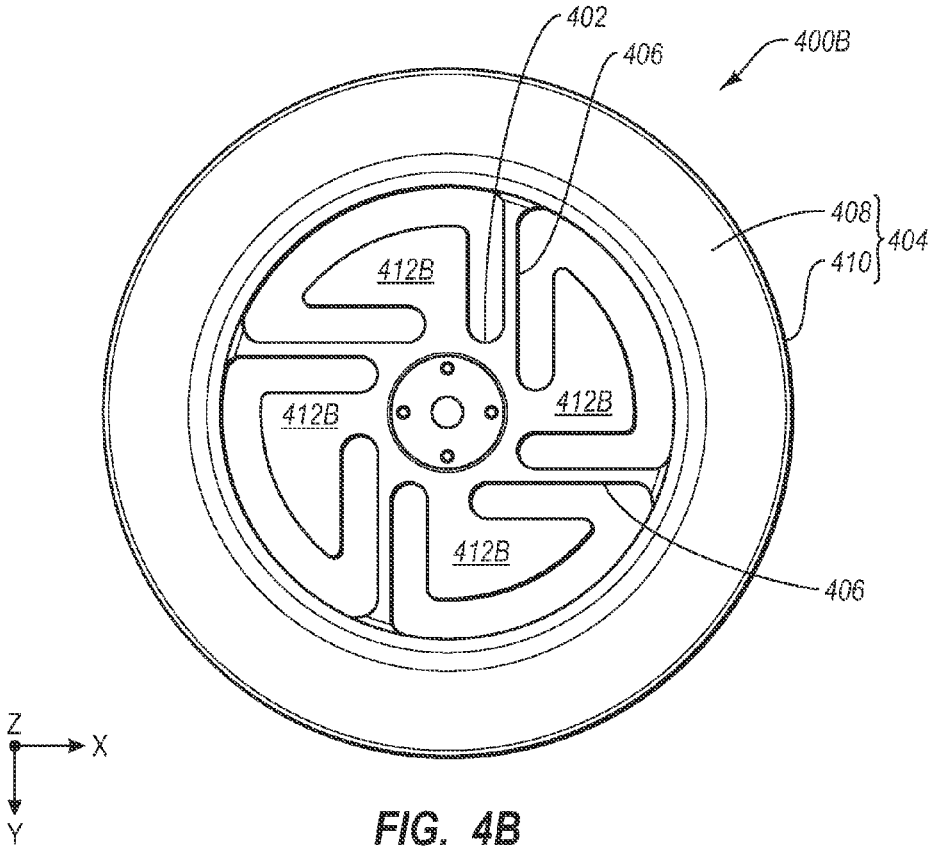

For instance, FIGS. 4A and 4B respectively disclose example anodes 400A, 400B that at least partially thermally isolate hubs from targets by conductive isolation of the hubs from the targets, without providing substantial radiative isolation. In more detail, FIGS. 4A and 4B disclose anodes 400A and 400B comprising a hub 402, target 404, and a plurality of spokes 406 substantially tangentially connected to the hub 402. The target 404 comprises a focal track 408 and a substrate 410. Additionally, each of anodes 400A, 400B includes a plurality of heatsinks 412A, 412B, respectively, formed in the anode 400A, 400B.

The heatsinks 412A, 412B are interposed between the spokes 400A. In the anode 400A of FIG. 4A, the heatsinks 412A are directly connected to the target 404. More particularly, in some examples, the heatsinks 412A are directly connected to the substrate 410. In the anode 400B of FIG. 4B, the heatsinks 412B are directly connected to the hub 402.

Anodes 400A, 400B that include heatsinks 412A, 412B may be useful in a variety of applications, such as computed tomography ("CT") applications, that require anodes with relatively high minimum masses. In some examples, the heatsinks 412A, 412B can be integral with the hub 402, spokes 406 and target 404 substrate 410, all of which can be integrally formed from an anode blank.

As explained above, the spokes 406 can substantially mechanically isolate the hub 402 from the target 404 by resiliently deforming in the x-y plane to accommodate radial expansion and contraction of the target 404. The spokes 406 additionally provide at least some thermal isolation for the hub 402 from the target 404 by conductively isolating the hub 402 from the target 404 via the spokes 406 as explained above with respect to the anode 200 of FIGS. 2A-2D.

In both of FIGS. 4A and 4B, however, the anodes 400A, 400B do not radiatively isolate the hub 402 from the target 404 to the same extent as the anode 200 of FIGS. 2A-2D. Instead, the heatsinks 412A, 412B bridge much of the distance that would otherwise separate the hub 402 from the target 404 such that the hub 402 is not radiatively isolated from the target 404 in either of the anodes 400A, 400B to the same extent as hub 202 of FIGS. 2A-2D. As a result, in the example of FIG. 4A, thermal energy at the target 404 can be conductively transferred to the heatsinks 412A, radiated across the gap from the heatsinks 412A to the hub 402, and then partially absorbed by the hub 402. Similarly, in the example of FIG. 4B, thermal energy at the target can be radiated across the gap from the target 404 to the heatsinks 412B, partially absorbed by the heatsinks 412B, and then conductively transferred from the heatsinks 412B to the hub 402.

The anode 400A may find use and application in a number of different environments, including CT applications. For instance, CT applications often require anodes with high thermal storage capacity. Because the heatsinks 412A are directly connected to the target 404, the heatsinks 412A can conductively draw and store thermal energy away from the target 404 without conducting the thermal energy to the hub 402. Even though the proximity of the heatsinks 412A to the hub 402 facilitates radiative transfer of a portion of the thermal energy stored in the heatsinks 412A to the hub 402, radiative transfer is much less efficient than conductive transfer such that the hub 402 operates at significantly lower temperatures than the target 404 despite the proximity of the heatsinks 412A to the hub 402.

Alternately or additionally, the anode 400B may find use and application in environments including diagnostic systems that require anodes with relatively high minimum masses and that subject the anodes to short periods of high heat load interrupted by long periods of low or zero heat load. In this example, heatsinks 412B are connected directly to the hub 402 and thermal energy conductively transferred to the hub 402 via spokes 406 can be absorbed by the heatsinks 412B such that the heatsinks 412B dampen the inrush of thermal energy.

The anodes 400A and 400B can be implemented in environments other than those described above. As such, the environments described above should not be construed to limit the invention in any way. Additionally, even though FIG. 4A discloses an anode 400A having heatsinks 412A that are all connected directly to the target 404 and FIG. 4B discloses an anode 400B having heatsinks 412B that are all connected directly to the hub 402, embodiments of the invention can also include anodes having some heatsinks connected directly to the target and other heatsinks connected directly to the hub.

D. General Aspects of Some Anodes

Embodiments of the invention include anodes having hubs, target substrates and spokes made from the same or different materials. For instance, the hubs, target substrates and spokes can be integral with each other, as in the example of FIGS. 2A-2D and 4A-4B, in which case the material(s) of the hubs, target substrates and spokes can be the same. Alternately, the hubs, target substrates and spokes may be discrete from each other, as in the example of FIG. 3, in which case the hubs, target substrates and spokes can be made from the same or different materials.

In some embodiments, the hubs 202, 302, 402 of anodes 200, 300, 400A, 400B comprise stainless steel, such as 304L stainless steel, or high-performance alloy, such as Hastelloy B or Hastelloy C. Alternately or additionally, the hubs 202, 302, 402 can comprise the same material(s) as the targets 204, 304, 404 and/or spokes 206, 310, 406.

The targets 204, 304, 404 of anodes 200, 300, 400A, 400B, including focal tracks 208, 306, 408 and/or substrates 210, 308, 410, can comprise refractory material(s), including one or more of: tungsten, rhenium, TZM alloy, MHC alloy, molybdenum, graphite, tantalum carbide, tantalum-hafnium carbide, or other suitable material(s).

The spokes 206, 310, 406 of anodes 200, 300, 400A, 400B can be made from plate or sheet materials, wire, tubing, or other materials. Alternately or additionally, the spokes 206, 310, 406 can comprise one or more of: tantalum, niobium, hafnium, zirconium, titanium, vanadium, high-content alloys of the aforementioned elements, or other suitable material(s). Alternately or additionally, the spokes 206, 310, 406 can be made from the same material(s) as the hubs 202, 302, 402 and/or targets 204, 304, 404.

As already explained above, embodiments of the invention include anodes having hubs that are substantially mechanically isolated from corresponding targets via spokes that are substantially tangentially connected to the hubs. For instance, FIG. 5A discloses an anode 500 in simplified form that may correspond to the anodes 200, 300, 400A, 400B of FIGS. 2A-4B. The anode 500 comprises a hub 502, target 504 and a plurality of spokes 506 that are substantially tangentially connected to the hub 502.

Figure 5A:
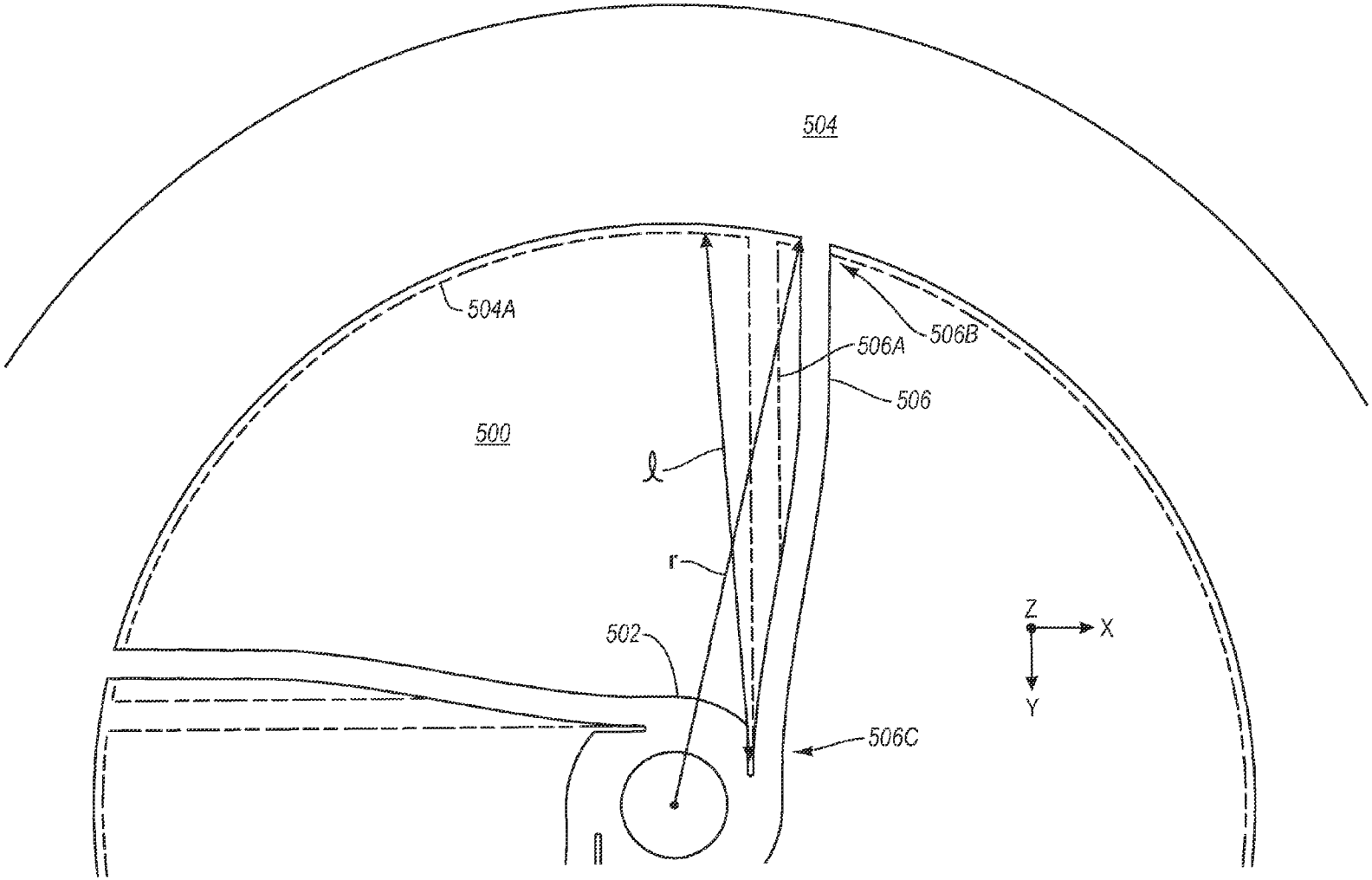
FIG. 5A illustrates an example anode having a substantially mechanically isolated hub accommodating radial expansion of the target.

In the example of FIG. 5A, the spokes 506 are displaced from an initial position 506A as a result of radial expansion of the target 504 from an initial position 504A during operation. The target 504 can expand due to radial stresses from being rotated at high speed during operation and/or due to thermal loading of the target 504 during operation. A spoke connected substantially normally to the hub 502 would have to stretch to accommodate the radial expansion of the target 504 from the initial position 504A to the operating position shown in FIG. 5A. According to the present example, however, the tangential connection of the spokes 506 to the hub 502 allows the spokes 506 to rotate out of their original position 506A to accommodate the radial expansion of the target 504 without being stretched. More particularly, the rotation of the spokes 506 out of their initial position 506A increases the effective length of the spokes 506, e.g. the radial distance r measured from the hub 502 to the target end 506B of the spokes 506, without substantially increasing the actual length of the spokes 506, e.g., the distance I measured from the hub end 506C to the target end 506B.

As explained above, the spokes 506 can be made from resilient material(s) to allow the spokes 506 to resiliently deform and thereby rotate in and out of their initial position 506A as the target 504 radially expands and contracts. Alternately or additionally, the spokes 506 can be hinged at one or both of the target ends 506B and hub ends 506C to allow the spokes 506 to rotate. Further, although the rotation of the spokes 506 in and out of their initial position 506A may cause bending stresses in the spokes 506, such as at the target ends 506B and/or at the hub ends 506C, the bending stresses caused by rotating the spokes 506 out of their initial position 506A are smaller than tensile stresses would be if the spokes 506 were stretched, rather than rotated, to accommodate the radial expansion of the target 504.

Embodiments of the invention can alternately or additionally include anodes having hubs that are substantially thermally isolated from targets via spokes connected between the hubs and the targets. For instance, FIG. 5B discloses a computer-modeled temperature profile for an example anode 550 having a thermally isolated hub. The anode 550 may correspond to the anodes 200, 300, 400A, 400B of FIGS. 2A-4B and comprises a hub 552, target (not shown) and a plurality of spokes 554 that are substantially tangentially connected to the hub 552. Each of the spokes 554 includes a hub end 556 and a target end 558.

Figure 5B:
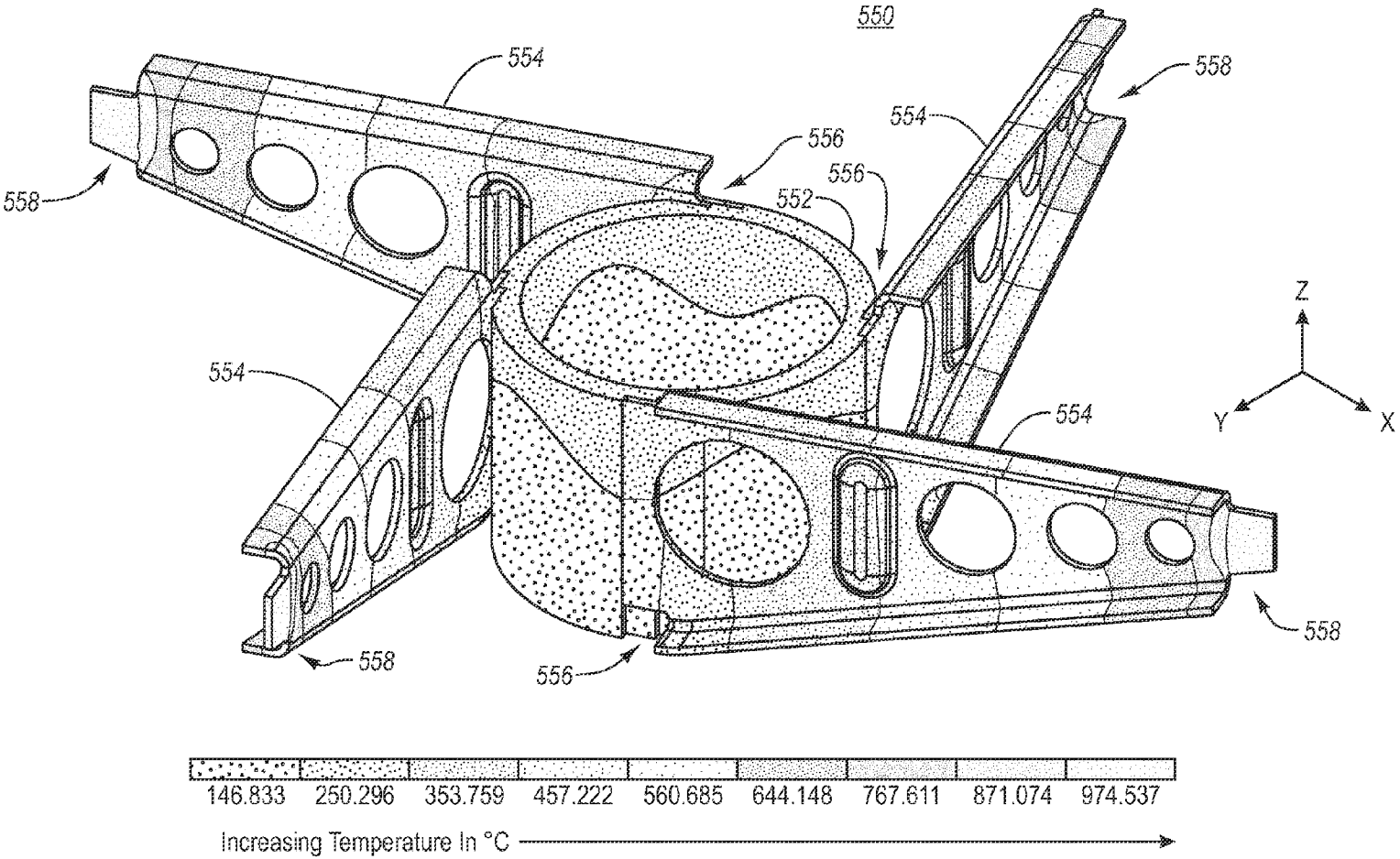
FIG. 5B illustrates a temperature profile of an example anode having a substantially thermally isolated hub.
Figure 6:
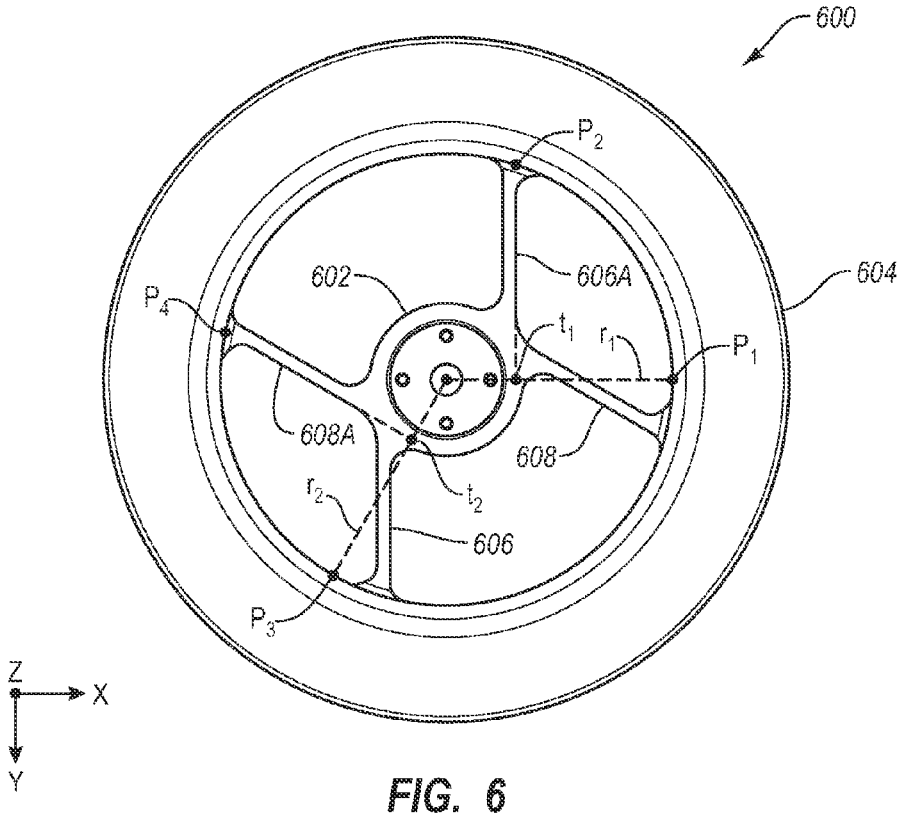
FIG. 6 is a top view of an example anode having spokes spaced non-uniformly about the hub.
Figure 7:
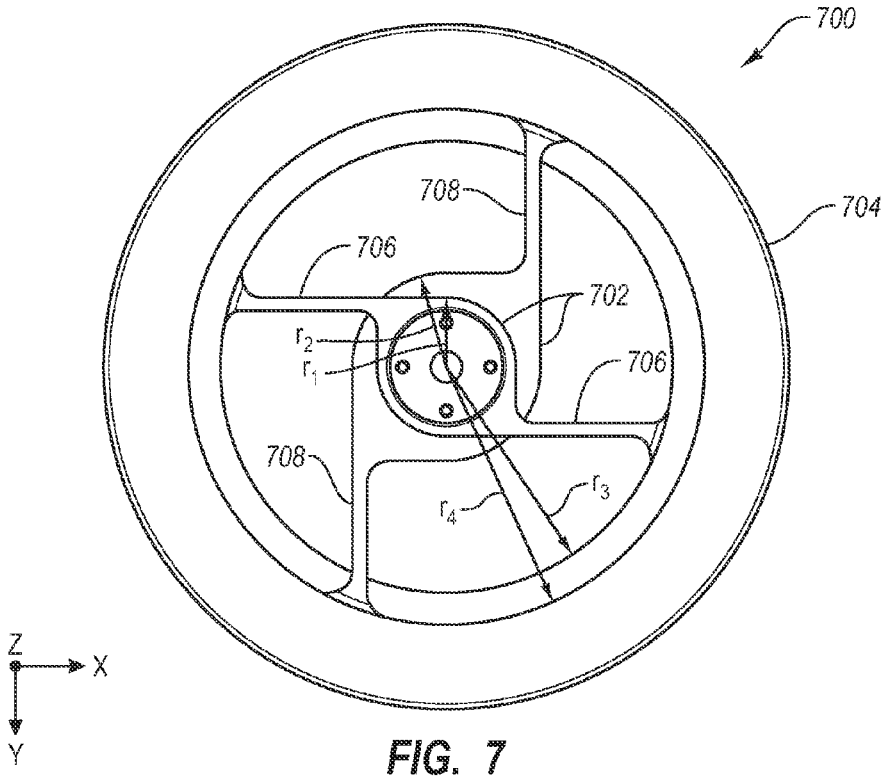
FIG. 7 is a top view of an example anode having spokes connected to the hub and target at different radial distances.

As can be seen in FIG. 5B, temperatures at the target ends 558 of spokes 554 are near 1100° C. where the spokes 554 connect to the target. The narrowness of the substantially wedge-shaped spokes 554 at the target ends 558 creates a bottleneck for conduction of thermal energy away from the target. As a result, only a relatively small amount of thermal energy can be conductively transferred through the target ends 558 of spokes 554. As the substantially wedge-shaped spokes 554 broaden towards the hub ends 556, the thermal energy conductively transferred through the target ends 558 spreads out and partially dissipates via radiation from the spokes 554, further reducing the amount of thermal energy that reaches the hub 552 via conduction. Consequently, in one embodiment, temperatures at the hub ends 556 of spokes 554 are approximately 250° C. and temperatures at the hub are approximately 150° C. Thus, according to the embodiment of FIG. 5B, there is a temperature difference from the target ends 558 of spokes 554 to the hub 552 of approximately 900° C.

The temperature profile of FIG. 5B is provided by way of illustration only, and should not be construed to limit the invention. Indeed, embodiments of the invention do not require anodes having temperature profiles that are identical or even similar to the temperature profile of FIG. 5B. Further, embodiments of the invention can include anodes configured to substantially thermally isolate hubs from targets such that the temperature difference from the target to the hub is approximately 900° C., or such that the temperature difference from the target to the hub is more or less than 900° C.

FIGS. 2A-5B disclose anodes 200, 300, 400A, 400B, 500, 550 having spokes 206, 310, 406, 506, 554 that are substantially tangentially connected to hubs 202, 302, 402, 502, 552 in the same direction. Specifically, the spokes 206, 310, 406, 506, 554 are all tangentially connected to hubs 202, 302, 402, 502, 552 in the counterclockwise direction. In other embodiments, the spokes 206, 310, 406, 506, 554 can all be tangentially connected to hubs 202, 302, 402, 502, 552 in the clockwise direction.

Embodiments of the invention alternately include anodes having spokes that are spaced non-uniformly and/or that are substantially tangentially connected to hubs in opposite directions. For example, FIG. 6 discloses one example of an anode 600 comprising a hub 602, target 604 and a plurality of spokes 606, 608 that are spaced non-uniformly and that are substantially tangentially connected to the hub 602 in opposite directions. Spokes 606 include spoke 606A. Spokes 608 include spoke 608A. As shown, spokes 606 are tangentially connected to hub 602 in the counterclockwise direction, while spokes 608 are tangentially connected to hub 602 in the clockwise direction.

Generally, a spoke 606A is tangentially connected to a hub 602 in a counterclockwise direction if, from the point of tangency $t_1$ of the spoke 606A and relative to a point $P_1$ on the target 604 ($P_1$ is defined as the point on the target 604 where a radial line $r_1$ extending from the hub 602 through $t_1$ connects to the target 604), the spoke 606A extends to the target 604 so as to connect to the target 604 at a point $P_2$, where the shortest circumferential distance from $P_1$ to $P_2$ is in the counterclockwise direction. Similarly, a spoke 608A is tangentially connected to the hub 602 in a clockwise direction if, from the point of tangency $t_2$ of the spoke 608A and relative to a point $P_3$ on the target 604 ($P_3$ is defined as the point on the target 604 where a radial line $r_2$ extending from the hub 602 through $t_2$ connects to the target 604), the spoke 608A extends to the target 604 so as to connect to the target 604 at a point $P_4$, where the shortest circumferential distance from $P_3$ to $P_4$ is in the clockwise direction.

FIGS. 2A-5B additionally disclose anodes 200, 300, 400A, 400B, 500, 550 having spokes 206, 310, 406, 506, 554 that are connected to the hubs 202, 302, 402, 502, 552 and targets 204, 304, 404, 504 at the same radial distances from the axis of rotation. For instance, with reference to FIG. 2C, all four hub ends 212 of spokes 206 are substantially tangentially connected to the hub 202 at a first radial distance from the axis of rotation $A_1$. Similarly, all four target ends of spokes 206 are connected to the target 204 at a second radial distance from the axis of rotation $A_1$.

Embodiments of the invention alternately include anodes having spokes that are connected to hubs at multiple radial distances and/or that are connected to targets at multiple radial distances. For instance, FIG. 7 discloses one example of an anode 700 comprising a hub 702, target 704 and a plurality of spokes 706, 708 that are substantially tangentially connected to the hub 702 at multiple radial distances and that are connected to the target 704 at multiple radial distances. More particularly, the hub ends of spokes 706 are substantially tangentially connected to the hub 702 at a first radial distance $r_1$, while the hub ends of spokes 708 are substantially tangentially connected to the hub 702 at a second radial distance $r_2$. Similarly, the target ends of spokes 706 are connected to the target 704 at a third radial distance $r_3$, while the target ends of spokes 708 are connected to the target 704 at a fourth radial distance $r_4$.

III. Method of Making an Anode

Figure 8A:
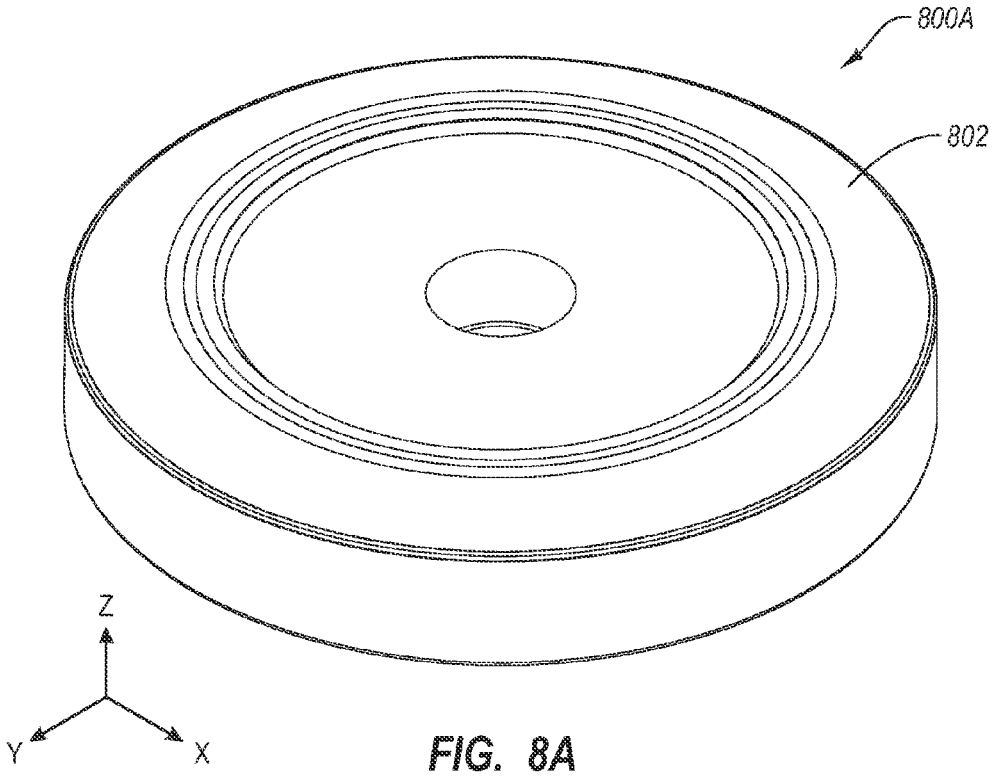
FIGS. 8A-8D are isometric views of an anode at various stages of formation.
Figure 8B:
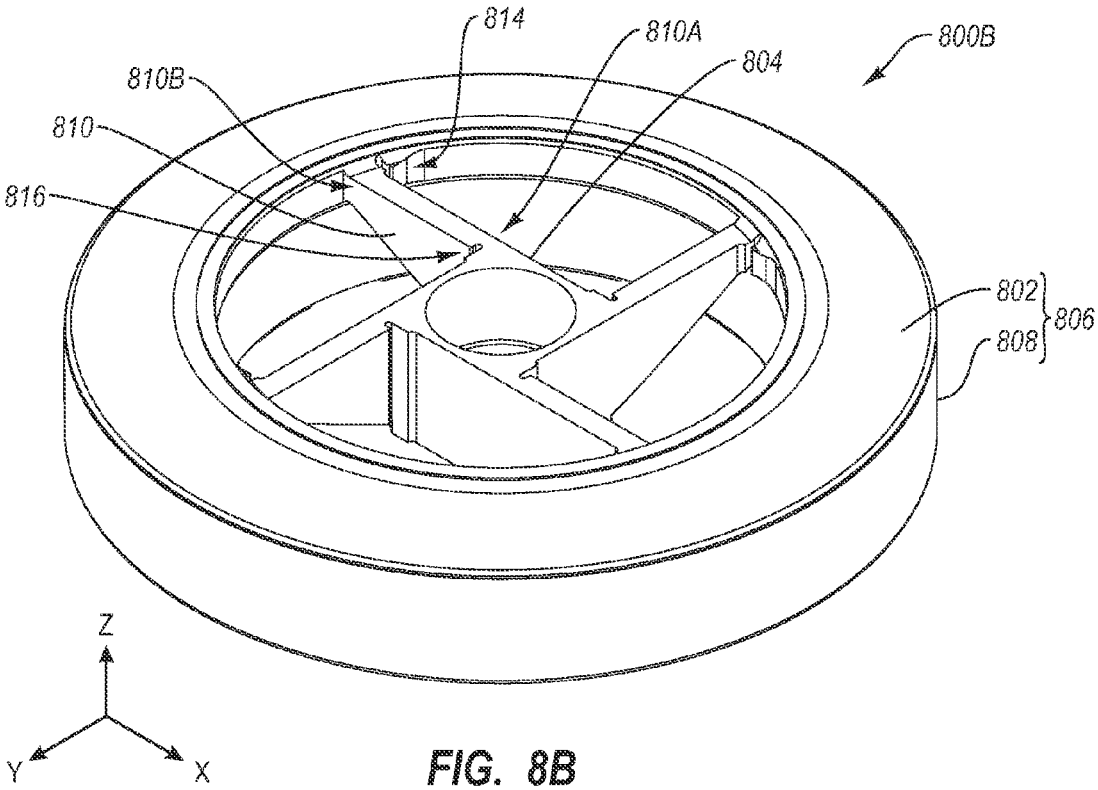
Figure 8C:
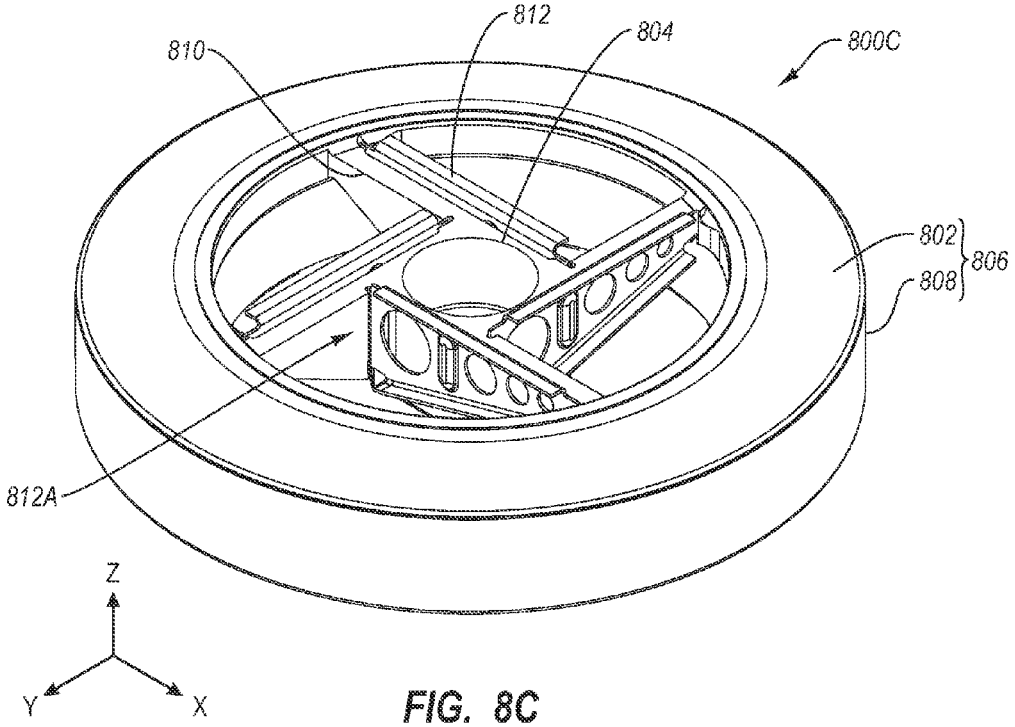
Figure 8D:
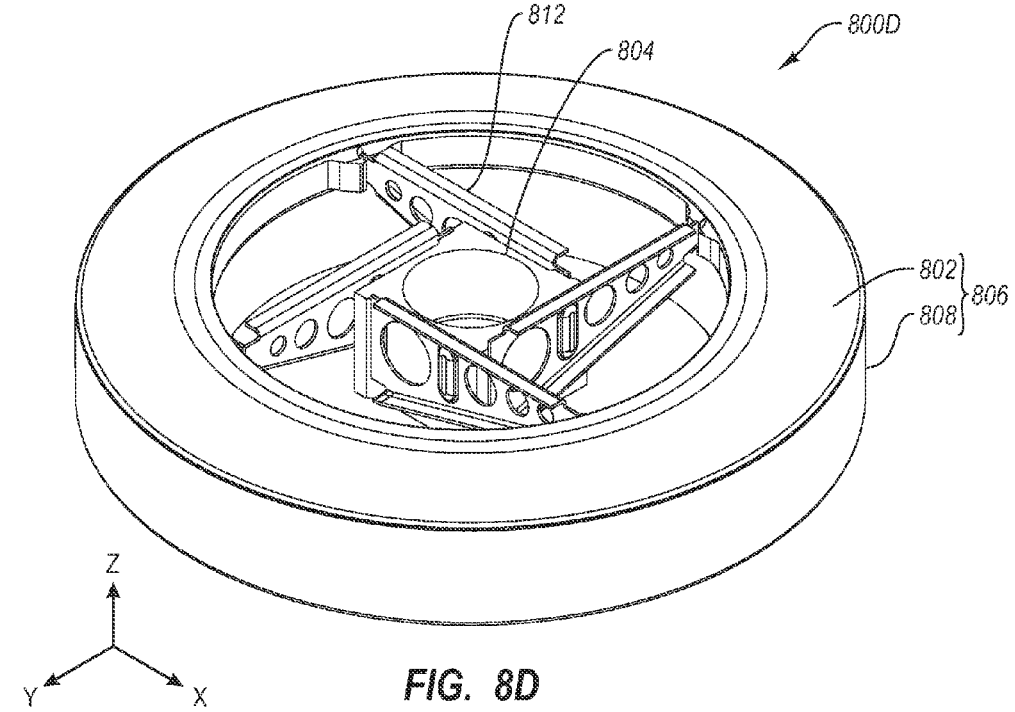
Figure 9:
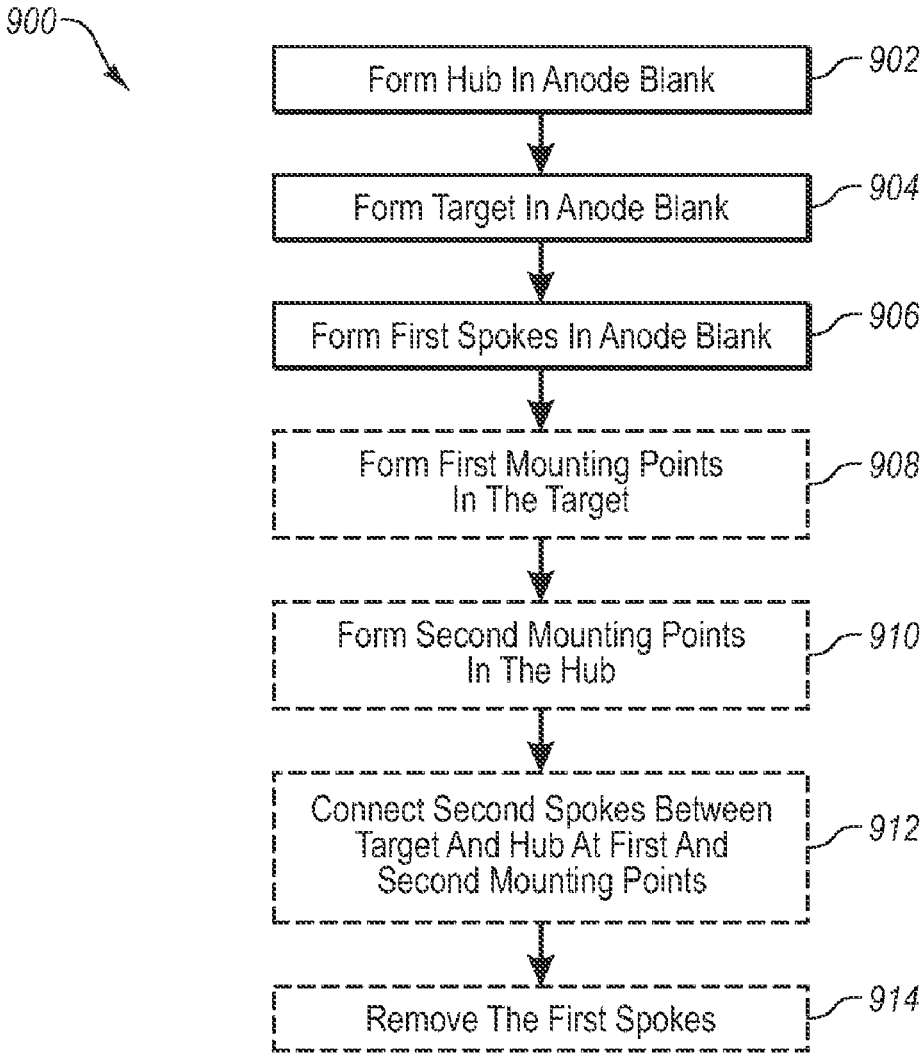
FIG. 9 illustrates a flow chart of an example method for making an anode.

Turning next to FIGS. 8A-9, one embodiment of a method for making an anode is disclosed. As shown, FIGS. 8A-8D illustrate, at various stages of formation, isometric views of an anode configured to thermally and/or mechanically isolate a hub of the anode. FIG. 9 illustrates steps in an example method for making the anode of FIGS. 8A-8C.

More particularly, FIG. 8A illustrates an anode blank 800A that may comprise an anode billet. In some embodiments, the anode blank 800A comprises refractory material. In the present example, the anode blank 800A includes a focal track 802 attached to a portion of the anode blank 800A that is subsequently formed into the target. FIG. 8B illustrates a first partially processed anode blank 800B resulting from forming the hub 804, target 806 comprising focal track 802 and substrate 808, and first spokes 810 in the anode blank 800A. As shown in FIG. 8B, the hub 804, substrate 808 and first spokes 810 are integral with each other. At least one example embodiment of an anode is configured as shown in FIG. 8B, though such configuration may be further processed to create the embodiment of FIG. 8D. FIG. 8C illustrates a second partially processed anode blank 800C resulting from connecting second spokes 812 between the hub 804 and target 806 in the first partially processed anode blank 800B of FIG. 8B. FIG. 8D illustrates an anode 800D formed by removing the first spokes 810 from the second partially processed anode blank 800C of FIG. 8C.

FIG. 9 illustrates a flow chart of an example method 900 for forming the anode 800D of FIG. 8D. The method 900 of FIG. 9 will be discussed in the context of FIGS. 8A-8D. The method 900 begins by forming the hub 804 in the anode blank 800A at stage 902. At stage 904, the target 806 is formed in the anode blank 800A. At stage 906, the first spokes 810 are formed in the anode blank 800A. The first spokes 810 can be formed in the anode blank 800A such that the first spokes 810 are substantially tangentially connected to the hub 804 at hub ends 810 of the first spokes 810. Although stages 902, 904 and 906 are described as discrete stages, in other embodiments, stages 902, 904 and 906 are all performed simultaneously. Alternately or additionally, stages 902, 904 and 906 can be performed in a different order than described herein.

The stages 902, 904 and 906 of forming the hub 804, target 806 and spokes 810 can be performed using any process now known or later developed, such as electrical discharge machining ("EDM"), etching, grinding, or any combination thereof Further, in some embodiments, the stage 904 of forming the target 806 in the anode blank 800A includes attaching the focal track 802 to the anode blank 800A, either before or after the substrate 808 is formed in the anode blank 800A. The focal track 802 can be attached to the substrate 808, or to the portion of the anode blank 800A subsequently formed into the substrate 808, via welding, brazing, or other suitable process.

Moreover, embodiments of the invention contemplate terminating the method 900 of FIG. 9 after completing all of stages 902, 904 and 906. For instance, anodes having a hub, target substrate and spokes that are integral with each other, such as the anode 200 of FIGS. 2A-2D, can be formed according to embodiments of the method 900 of FIG. 9, comprising stages 902, 904 and 906. Accordingly, although FIG. 8B has been described as illustrating a "first partially processed anode blank 800B," it can alternately be described as illustrating a complete anode 800B comprising hub 804, substrate 808 and first spokes 810 that are integral with each other.

Optionally, embodiments of the invention can further include one or more of stages 908, 910, 912 and 914. For instance, with combined reference to FIGS. 8B and 9, first mounting points 814 are formed in the target 806 near target ends 810B of the first spokes 810 at stage 908 and second mounting points 816 are formed in the hub 804 near hub ends 810A of the first spokes 810 at stage 910. With combined reference to FIGS. 8C and 9, at stage 912, second spokes 812 are connected between the target 806 and hub 804 at the first and second mounting points 814, 816. Stage 912 includes connecting the second spokes 812 such that hub ends 812A of the second spokes 812 are substantially tangentially connected to the hub 804. Further, the second spokes 812 can be connected at first and second mounting points 814, 816 via welding, brazing, or any other suitable process(es). With combined reference to FIGS. 8D and 9, the first spokes 810 are removed at stage 914 to form the complete anode 800D.

Embodiments of the method 900 facilitate alignment of the geometric axes of rotation of the hub 804 and the target 806. For instance, the geometric axis of rotation of the anode blank 800A can easily be located for the anode blank 800A of FIG. 8A and used as a reference point when forming the first partially processed anode blank 800B of FIG. 8B such that the hub 804 and target 806 are substantially concentric with each other. Thus, when the method 900 of FIG. 9 is terminated after completing stages 902-906 to form an anode having a hub, target substrate and spokes that are integral with each other, the hub and target are substantially concentric with each other.

Alternately, the first spokes 810 substantially maintain the concentric alignment of the hub 804 and target 806 when the second spokes 812 are connected between the hub 804 and target 806 at stage 912 to form the second partially processed anode blank of FIG. 8C. Accordingly, when the first spokes 810 are subsequently removed at stage 914 to form the anode 800D of FIG. 8D, the second spokes 812 substantially maintain the concentric alignment of the hub 804 and target 806 since the second spokes 812 were connected when the hub 804 and target 806 were already concentrically aligned.

It will be appreciated by those of skill in the art that the process of FIG. 9 described above is provided by way of illustration and not by way of limitation and that process stages and/or actions can be rearranged in order and combined or eliminated and that other actions may be added due to design considerations depending on the desired implementation of an anode formed according to the method 900 of FIG. 9. For example, the method 900 can be terminated after completing stages 902, 904 and 906 as already explained above. Alternately or additionally the method 900 can include integrally forming a plurality of heatsinks, such as the heatsinks 412A, 412 B of FIGS. 4A and 4B, in the anode blank 800A.

IV. Alternative Embodiments

Figure 10:
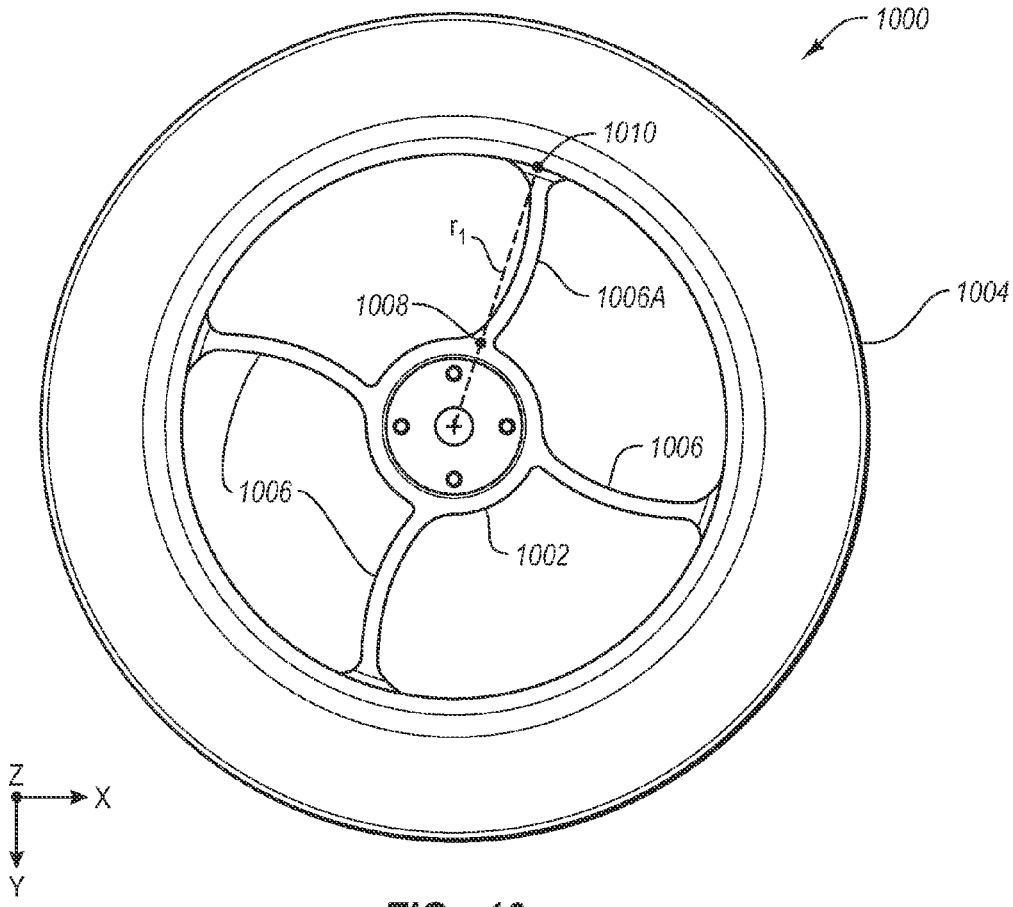
FIG. 10 illustrates the top view of yet another example of an anode having an alternative spoke configuration.

FIG. 10 discloses an example anode 1000 comprising a hub 1002, target 1004, and plurality of spokes 1006, including spoke 1006A. Similar to the embodiments of FIGS. 2A-8D, the anode 1000 of FIG. 10 is configured to substantially mechanically and/or thermally isolate the hub 1002 from the target 1004 via the spokes 1006. In contrast to the embodiments of FIGS. 2A-8D, however, the spokes 1006 of FIG. 10 are curvilinear, rather than substantially linear. Further, the spokes 1006 are not connected to the hub 1002 in a substantially tangential manner.

In the example of FIG. 10, each of spokes 1006 is resiliently deformable, allowing the spokes 1006 to resiliently deform in the arbitrarily-defined x-y plane to accommodate radial expansion and contraction of the target 1004. In more detail, in some embodiments, the spokes 1006 are configured to resiliently deform from their curvilinear configuration shown in FIG. 10 toward a more linear configuration so as to increase the radial distance between the hub 1002 and the target 1004 and thereby accommodate radial expansion of the target 1004. By resiliently deforming in the x-y plane during operation, the spokes 1006 substantially mechanically isolate the hub 1002 from the target 1004.

Alternately or additionally, each of spokes 1006 can comprise material(s) characterized by low work hardening to facilitate resilient or elastic deformation of the spokes 1006. Accordingly, in some embodiments, the spokes 1006 comprise one or more of tantalum, niobium, hafnium, zirconium, titanium, vanadium, high-content alloys of the aforementioned elements, or other suitable material(s).

In some embodiments of the invention, the endpoints of the spokes 1006 are arranged on radials from the center of rotation of the anode 1000 outward to the target 1004. For instance, spoke 1006A includes a hub endpoint 1008 and a target endpoint 1010. As can be seen in FIG. 10, both the hub endpoint 1008 and the target endpoint 1010 are attached to the hub 1002 and the target 1004, respectively, such that the hub endpoint 1008 and target endpoint 1010 are arranged on a radial $r_1$ extending from the center of rotation of anode 1000 out to the target 1004. In other embodiments, the endpoints of the spokes 1006 are not arranged on radials from the center of rotation.

Accordingly, embodiments of the invention are not limited to anodes having substantially linear spokes that are substantially tangentially connected to hubs, such as in the examples of FIGS. 2A-8D. Rather, embodiments of the invention include virtually any spoke configuration, be it substantially linear or curvilinear and whether substantially tangentially connected to the hub or not, that is configured to substantially mechanically isolate the hub from the target, including the configurations of FIGS. 2A-8D and 10.

In addition to substantially mechanically isolating the hub 1002 from the target 1004, the spokes 1006 can alternately or additionally be configured to substantially thermally isolate the hub 1002 from the target 1004 by substantial conductive and/or radiative isolation, as explained with respect to the embodiments described above. As such, in some embodiments, each of spokes 1006 comprises a substantially wedge-shaped body that is thicker at the hub endpoint 1008 than at the target endpoint 1010. Alternately or additionally, each of spokes 1006 can include one or more cutouts to further reduce the cross-sectional area of each spoke 1006.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A rotating anode, comprising:

an anode hub rotatably supported by an anode support assembly;

an annular target; and a plurality of spokes connecting the anode hub to the annular target, the plurality of spokes being configured to substantially mechanically isolate the anode hub from the annular target, wherein each of the plurality of spokes further includes;

a resilient hub end configured to resiliently deform in a plane substantially normal to the first axis of rotation;

a resilient target end configured to resiliently deform in the plane substantially normal to the first axis of rotation;

a substantially wedge-shaped body that is broader at the hub end than the target end: and at least one flange formed lengthwise between the hub end and the target end along at least one edge of the wedge-shaped body.

2. The anode of claim 1, wherein the plurality of spokes are substantially curvilinear and include endpoints arranged on radials from a center of rotation of the anode out to the annular target, the plurality of spokes being configured to resiliently deform to accommodate radial expansion and contraction of the annular target during operation.

3. The anode of claim 1, wherein each of the plurality of spokes is substantially tangentially connected to the anode hub.

4. The anode of claim 3, wherein the plurality of spokes are substantially tangentially connected to the anode hub in the same direction.

5. The anode of claim 3, wherein:

each of the plurality of spokes comprises a hub end connected to the anode hub and a target end connected to the annular target;

the anode hub defines an axis of rotation; and one or both of:

the hub ends of a first set of the plurality of spokes are substantially tangentially connected to the anode hub at a first radial distance from the axis of rotation and the hub ends of a second set of the plurality of spokes are substantially tangentially connected to the anode hub at a second radial distance from the axis of rotation that is different than the first radial distance; or the target ends of a third set of the plurality of spokes are connected to the annular target at a third radial distance from the axis of rotation and the target ends of a fourth set of the plurality of spokes are connected to the annular target at a fourth radial distance from the axis of rotation that is different than the third radial distance.

6. The anode of claim 1, further comprising a set of fins formed in the annular target for radiating thermal energy away from the annular target.

7. The anode of claim 1, wherein the anode hub comprises one or more of:

stainless steel or high-performance alloy.

8. The anode of claim 1, wherein the annular target comprises one or more of: tungsten, rhenium, molybdenum, graphite, tantalum carbide, tantalum-hafnium carbide, tungsten zirconium molybdenum ("TZM") alloy, or molybdenum hafnium carbide ("MHC") alloy.

9. The anode of claim 1, wherein each of the plurality of spokes comprises one or more of: the same material as the anode hub, the same material as the annular target, tantalum, niobium, hafnium, zirconium, titanium or vanadium.

10. The anode of claim 1, further comprising a plurality of cutouts formed in the wedge-shaped body of each of the plurality of spokes, the plurality of cutouts minimizing a thermal cross-section of each of the plurality of spokes.

11. The anode of claim 1, wherein the at least one flange formed in each of the plurality of spokes substantially prevents the annular target from moving axially with respect to the anode hub while the resilient hub end and the resilient target end of each of the plurality of spokes allow the plurality of spokes to resiliently deform without materially elongating to accommodate radial expansion of the annular target.

12. An x-ray tube, comprising:

an evacuated enclosure;

a cathode disposed within the evacuated enclosure; and a rotatable anode according to claim 1 disposed within the evacuated enclosure opposite the cathode so as to receive electrons emitted by the cathode.

13. An x-ray tube, comprising:

an evacuated enclosure;

a cathode disposed within the evacuated enclosure; and a rotatable anode disposed within the evacuated enclosure opposite the cathode so as to receive electrons emitted by the cathode, the anode comprising:

an anode hub rotatably supported by an anode support assembly;

an annular target; and a plurality of spokes connecting the anode hub to the annular target, each of the plurality of spokes being substantially tangentially connected to the anode hub and wherein each of the plurality of spokes is substantially tangentially connected to the anode hub;

each of the plurality of spokes comprises a hub end connected to the anode hub and a target end connected to the annular target;

the anode hub defines an axis of rotation; and one or both of:

the hub ends of a first set of the plurality of spokes are substantially tangentially connected to the anode hub at a first radial distance from the axis of rotation and the hub ends of a second set of the plurality of spokes are substantially tangentially connected to the anode hub at a second radial distance from the axis of rotation that is different than the first radial distance; or the target ends of a third set of the plurality of spokes are connected to the annular target at a third radial distance from the axis of rotation and the target ends of a fourth set of the plurality of spokes are connected to the annular target at a fourth radial distance from the axis of rotation that is different than the third radial distance.

14. The x-ray tube of claim 13, wherein a first set of the plurality of spokes are substantially tangentially connected to the anode hub in a first direction and a second set of the plurality of spokes are substantially tangentially connected to the anode hub in a second direction opposite the first direction.

15. The x-ray tube of claim 13, further comprising one or more obscuring structures in thermal contact with the evacuated enclosure and at least partially disposed between the annular target and the anode hub, the one or more obscuring structures configured to at least partially shield the anode hub from heat radiated by the annular target.

16. The x-ray tube of claim 13, further comprising:

a first set of fins formed in the annular target for radiating thermal energy away from the annular target;

a second set of firms formed in the evacuated enclosure and in thermal contact with the exterior of the x-ray tube, the second set of fins being interleaved with the first set of fins.

17. The x-ray tube of claim 13, wherein the annular target comprises a substrate and a focal track coupled to the substrate.

18. The x-ray tube of claim 17, wherein the substrate, the anode hub and the plurality of spokes are integral with each other.

19. The x-ray tube of claim 18, further comprising a plurality of heatsinks formed in the anode and interposed between the plurality of spokes, the plurality of heatsinks being directly connected to either the anode hub or the annular target and being integral with the substrate, the anode hub and the plurality of spokes.

20. The x-ray tube of claim 13, wherein the anode support assembly comprises a ball bearing assembly rotatably supporting the anode, the ball bearing assembly being coupled directly to the anode hub.

21. A rotating anode, comprising:

an anode hub rotatably supported by an anode support assembly;

an annular target; and a plurality of spokes connecting the anode hub to the annular target, the plurality of spokes being configured to substantially mechanically isolate the anode hub from the annular target, and wherein each of the plurality of spokes is substantially tangentially connected to the anode hub;

each of the plurality of spokes comprises a hub end connected to the anode hub and a target end connected to the annular target;

the anode hub defines an axis of rotation; and one or both of:

the hub ends of a first set of the plurality of spokes are substantially tangentially connected to the anode hub at a first radial distance from the axis of rotation and the hub ends of a second set of the plurality of spokes are substantially tangentially connected to the anode hub at a second radial distance from the axis of rotation that is different than the first radial distance; or the target ends of a third set of the plurality of spokes are connected to the annular target at a third radial distance from the axis of rotation and the target ends of a fourth set of the plurality of spokes are connected to the annular target at a fourth radial distance from the axis of rotation that is different than the third radial distance.

* * * * *